US007980180B2

(12) United States Patent
MacDougall

(10) Patent No.: US 7,980,180 B2
(45) Date of Patent: Jul. 19, 2011

(54) JACKETED ONE PIECE CORE AMMUNITION

(75) Inventor: John MacDougall, Montreal (CA)

(73) Assignee: General Dynamics Ordnance and Tactical Systems-Canada Inc., Le Gardeur, Quebec (CA)

( * ) Notice: Subject to any disclaimer, the term of this patent is extended or adjusted under 35 U.S.C. 154(b) by 1044 days.

(21) Appl. No.: 10/590,461

(22) PCT Filed: Feb. 23, 2005

(86) PCT No.: PCT/CA2005/000242

§ 371 (c)(1), (2), (4) Date: Aug. 23, 2006

(87) PCT Pub. No.: WO2005/080910

PCT Pub. Date: Sep. 1, 2005

(65) Prior Publication Data

US 2007/0163459 A1 Jul. 19, 2007

Related U.S. Application Data

(63) Continuation-in-part of application No. 10/783,032, filed on Feb. 23, 2004, now abandoned.

(51) Int. Cl.
*F42B 10/00* (2006.01)

(52) U.S. Cl. ..... 102/514

(58) Field of Classification Search ..... 102/514–518
See application file for complete search history.

(56) References Cited

U.S. PATENT DOCUMENTS

| | | | | | |
|---|---|---|---|---|---|
| 1,223,634 | A | | 4/1917 | Steinmetz | |
| 1,767,308 | A | * | 6/1930 | Phillips | 102/507 |
| 2,014,367 | A | * | 9/1935 | Breegle | 102/436 |
| 2,111,167 | A | * | 3/1938 | Carson | 102/448 |
| 2,288,604 | A | | 7/1942 | Born | |
| 2,303,449 | A | | 12/1942 | Fleischmann | |
| 2,322,751 | A | | 6/1943 | Studler | |
| 2,333,091 | A | * | 11/1943 | Crasnoff | 102/507 |
| 2,336,143 | A | | 12/1943 | Werme | |
| 2,683,416 | A | | 7/1954 | Keller et al. | |
| 3,348,486 | A | | 10/1967 | Rapp | |
| 3,553,804 | A | * | 1/1971 | Kopsch et al. | 86/55 |
| 3,795,196 | A | | 3/1974 | Hillenbrand | |
| 3,828,678 | A | * | 8/1974 | Bernath | 102/511 |
| 3,981,243 | A | | 9/1976 | Doris, Jr. | |
| 4,044,685 | A | | 8/1977 | Avcin | |
| 4,109,581 | A | | 8/1978 | Six | |
| 4,805,535 | A | * | 2/1989 | Marcon | 102/503 |
| 4,869,175 | A | | 9/1989 | McDougal | |
| 5,025,730 | A | | 6/1991 | Petrovich | |
| 5,069,139 | A | | 12/1991 | Denis | |
| 5,097,768 | A | * | 3/1992 | Petrovich | 102/510 |
| 5,175,392 | A | | 12/1992 | Denis | |

(Continued)

FOREIGN PATENT DOCUMENTS

| | | |
|---|---|---|
| FR | 762887 | 4/1934 |

(Continued)

*Primary Examiner* — Troy Chambers
(74) *Attorney, Agent, or Firm* — Sheema Khan; Miltons IP/p.i.

(57) ABSTRACT

A jacketed projectile having one-piece steel core provides good performance regarding chamber pressure, barrel wear and accuracy by separating the jacket from a central tapered portion of the core by providing an encircling air gap that facilitates engraving of the jacket during firing.

19 Claims, 4 Drawing Sheets

U.S. PATENT DOCUMENTS

| | | | | |
|---|---|---|---|---|
| 5,349,907 | A * | 9/1994 | Petrovich et al. | 102/506 |
| 5,463,960 | A | 11/1995 | Lowry | |
| 5,686,693 | A | 11/1997 | Jakobsson | |
| 5,794,320 | A | 8/1998 | Wernz et al. | |
| 6,070,532 | A | 6/2000 | Halverson | |
| 6,085,661 | A | 7/2000 | Halverson et al. | |
| 6,119,600 | A * | 9/2000 | Burri | 102/518 |
| 6,158,350 | A | 12/2000 | Pulcini | |
| 6,374,743 | B1 | 4/2002 | Hug et al. | |
| 2002/0020324 | A1 * | 2/2002 | Burczynski et al. | 102/507 |
| 2002/0152917 | A1 | 10/2002 | Weber | |
| 2005/0000385 | A1 * | 1/2005 | Booth | 102/514 |
| 2005/0066848 | A1 | 3/2005 | Muskat et al. | |

FOREIGN PATENT DOCUMENTS

| | | |
|---|---|---|
| FR | 2821151 | 8/2002 |
| GB | 592538 | 9/1947 |
| GB | 601686 | 5/1948 |
| GB | 2316471 | 5/1998 |
| NR | 309293 | 1/1920 |
| WO | 03/027602 | 4/2003 |

* cited by examiner

JACKETED ONE PIECE CORE AMMUNITION

This invention is a continuation-in-part of U.S. Ser. No. 10/783,032 filed Feb. 23, 2004 now abandoned.

FIELD OF THE INVENTION

This invention relates to spin stabilized projectiles fired from rifled gun barrels, and particularly to small arms ammunition.

BACKGROUND TO THE INVENTION

Historically, small calibre projectiles have been made from lead alloys or contained lead cores. Lead is an easy metal to form due to its' ease of malleability (very low Young's modulus) and projectile cores of this material readily deform under the high engraving stresses associated with a projectile being fired from a rifled gun barrel. Both of these material properties provide advantages for projectile design and permit good accuracy performance and low gun barrel wear.

However, in order to mitigate the barrel fouling associated with 1-piece, all-lead projectiles, copper-zinc alloy, (also known as gilding metal) jackets were introduced as shown in FIG. 1. These projectile jackets are thin enough in profile and ductile enough to deform adequately under the engraving stresses and transfer the spin from the rifling and still retain projectile integrity when the projectile leaves the muzzle of the gun. These 2-piece projectiles are still in production today, mainly for hunting and some military applications.

Further advances to projectile design have resulted in copper jacket bullets as in FIG. 2 with an ogival-shaped, a hardened steel penetrator portion in the front portion of the projectile and a cylindrical lead core at the aft of the penetrator portion. Antimony may be mixed with the lead for increased strength. The jacket allows the integration of the two penetrator and core elements to reach the target together and provide as well the desired interior ballistic performance. This style of three-piece projectile is commonly referred to as "ball" ammunition. This design has improved terminal ballistic effects over all-lead core projectiles and allows increased penetration of hard targets due to the addition of the very hard penetrator while still permitting good accuracy and acceptable barrel wear due to the lead/antimony alloy core.

All NATO 5.56 mm and most common small calibre infantry weapons in service today currently feature such two-piece core projectiles due to the relative ease of manufacture, low production cost, reliability of performance and high lethality upon impact in the human body. Although the penetration performance of ball projectiles is superior in metal plates and other hard targets, performance is sometimes marginal when firing on the NATO standard steel plate targets during production lot acceptance testing in cold weather conditions. Thus, the current design is at its design limits for penetration.

In recent times, lead has been shown to be a highly toxic substance and has been banned from use in gasoline and paints, to name but two commercial products previously containing lead. In addition, many tons of lead have been entering the water system every year through the simple loss of lead fishing sinkers and these too which are now prohibited in many localities due to the toxic effect on the environment and the food chain. Additionally, the manufacturing process may expose persons working in the environs of the projectile production equipment to lead and/or lead dust resulting in a potential health hazard.

These same health concerns are leading government agencies around the world to mandate the elimination of lead from the production of small calibre ammunition. This trend applies to commercial as well as military products, but numerous technical challenges have delayed this thrust for military products. One of the objectives of the elimination of lead is to reduce airborne contaminants in the shooter's breathing zone.

The first challenge is to find a suitable replacement material for lead. Lead is an inexpensive and extremely soft, easily formed metal, almost ideal for manufacturing purposes.

Lead is also a high-density material, which is a great advantage to the ballistician. A heavier projectile for a given shape will travel farther and retain its velocity better at longer ranges.

The objective of any infantry fighter is to incapacitate the enemy and this is most often achieved by the transfer of kinetic energy to the target. Thus, a heavier projectile will transfer more energy to a given target than a lighter version for hits with the same impact velocity.

Clearly, any lead-free projectile should ideally have the same muzzle velocity and mass as the steel and lead containing ball projectile it seeks to replace. The other obvious advantage of having a lead-free projectile of nearly identical mass relates to the requirement of retaining the same exterior ballistic performance. Otherwise all current weapon sighting systems would require replacement, re-working or extensive re-adjustment and existing ballistic firing tables would no longer be valid. This would place an unacceptable logistical burden on most military forces of any significant size in the world.

Replacing lead as a core material for projectiles has not been a simple matter. Previous projectile designs considered in the past have not been able to maintain the mechanical and physical properties of lead so as to achieve comparable exterior ballistic performance. For example, the ability of the projectile to retain its velocity and energy is measured by its sectional density and is proportional to the projectile mass divided by the square of the calibre. Thus, it is seen that a projectile of lower mass or density will not retain its velocity and energy as well as a projectile of higher mass and energy. This leads to the conclusion that, for a given calibre, a projectile comprised of a lower density material should be longer to retain the same mass as a lead filled projectile.

Recent efforts to replace lead in projectiles have focused on high density powdered metals, such as tungsten with polymeric or metallic binders. However, these replacement materials have yet to meet all desired specifications and performance goals for stability, accuracy and economy of manufacture.

Many different materials and combinations of materials have been considered as replacements for the lead core in the manufacture of non-toxic projectiles. See U.S. Pat. No. 6,085,661 in which copper is used as a replacement for lead.

Another solution being explored is the replacement of lead with other high density metals such as bismuth. Bismuth metal possesses material properties similar to those of lead. Shotgun ammunition that utilizes bismuth shot is also commercially available, but the density of this metal is still only 86% of lead (9.8 versus 11.4 g/cm3), hence generating concerns regarding exterior ballistic performance. Two other problems with bismuth are the high cost of the raw material and its relative scarcity of supply in the world.

Lead has been used for many years in the form of pelletized projectiles, such as shotgun shot for hunting waterfowl and other game birds. Where lead shot has been banned, steel shot has sometimes been used. However, due to the high hardness and much lower density (7.5 versus 11.4 g/cm3), steels are less desirable choices for use as projectile materials due to the reduced terminal ballistic effect and increased barrel wear.

The manufacturers of steel pellet shot shells recommend using a steel shot at least two sizes larger in diameter than lead for the same target and similar distances. This further diminishes effectiveness by decreasing pattern density (the number of pellets per shot), thus reducing the probability of hit on a moving target. Although ammunition manufacturers are developing new and improved additives for use with steel shot, the ammunition appears to cause excessive wear and undue damage to many shotgun barrels.

Tungsten and bismuth are two high-density materials that have been attempted in alloy form with varying degrees of success in various commercial and military projectile designs. High-density depleted uranium and tungsten alloys have both been used for long rod kinetic energy penetrators for tank ammunition. Tungsten-nylon and tungsten-tin are two well-known combinations that rely on advanced powder metallurgy techniques to achieve the desired form of a one-piece projectile core for small calibre projectiles.

The objective of the jacketed tungsten-nylon or tungsten-tin powder metallurgy one-piece core projectile designs is to create a new material with an actual density equivalent to the hybrid density of the steel and lead components they replace, in order to maintain the same volume the two parts occupy. This new single piece would fit inside a copper projectile jacket as a "drop-in" replacement part and has the advantage of not requiring any changes whatsoever to existing high cadence projectile manufacturing or cartridge assembly machinery.

One disadvantage with these powder metallurgy concepts is that the process does not lend itself well to the manufacture of components that have to fit inside of another part and retain very close tolerances. Part of the reason for this problem is due to the irregular shrinkage associated with the sintering process that is often required of these powder metallurgy parts to achieve optimal density.

Normally, this tolerance problem can only be overcome by performing post-manufacturing operations on the sintered part, such as grinding. Obviously this increases cost and reduces production cadence, which is not desirable.

In addition, tungsten is also costly to obtain and in relatively scarce supply, which makes it considerably more expensive to manufacture and subject to price volatility. There are also potential procurement obstacles in the event of extended armed or economic conflicts involving the nations possessing this strategic element (or their neighbours) if either were unfriendly or unsympathetic during any such conflict.

Clearly, any replacement material for lead should be as abundant as possible to ensure a secure supply of raw materials and be as economical as possible to produce since infantry projectiles are considered a commodity nowadays. The replacement component should preferably be made of a single piece to reduce manufacturing and projectile assembly costs. Finally, the manufacturing process of the new core material should not require any post-manufacturing processes to ensure the current high production rate and capacity on existing projectile assembly equipment.

It is clear from the above that several attempts have been made in the past to obviate or diminish the use of lead as a primary material for making projectile cores. In spite of these efforts, no one heretofore has achieved satisfactory or economical projectile performance from non-lead materials.

This reduces the field of material contenders considerably and forces one to conclude that in fact a one-piece, all-steel core could be a serious contender if certain major technical challenges can be resolved.

A great advantage of the one-piece steel core projectile is its increased penetration performance in hard targets. Since the mass of the lead core has been replaced by an equivalent mass of steel, the penetration of the NATO standard steel plates is easily accomplished and at even greater ranges. This resolves the marginal penetration performance problem associated with conventional ball projectiles. The technical challenges facing old (current two-piece core design) and new (one-piece steel core) ball projectiles will be examined and the resulting solution is the basis for the new invention.

Technical Challenge 1 of Projectiles (Stripping)

High engraving stresses on current small calibre infantry projectiles may occasionally cause "projectile stripping" due to excessive shear forces acting on the jacket at the annular contact surface at the rearward end of the short steel penetrator. Projectile stripping occurs when the local shear stresses exceed the ultimate tensile strength of the projectile jacket material and the projectile breaks up upon exiting the muzzle.

If projectile stripping occurs, the projectile loses integrity upon exiting the muzzle, immediately becoming a critical safety hazard since its trajectory is unknown. The result of stripping is separation of the copper projectile jacket, lead core and steel penetrator in flight which is highly undesirable as it can lead to lethal accidents for friendly forces training or fighting nearby.

Projectile stripping has been known to occur when the diameter of the rearward end of the ogival section of the short steel penetrator exceeds that of the forward end of the cylindrical section of the lead core. The effect is one of a generating a sharp cutting edge on the inside of the copper jacket, magnified during the projectile engraving process.

Technical Challenge 2 of Projectiles (Reduced Penetration)

One possible solution to the problem of projectile stripping is to perform a post-production annealing of the projectiles. This heat treatment acts to relieve some of the residual stresses induced in the copper jacket during fabrication. This solution however creates other problems, as there is a negative effect on the penetration performance since the annealing process reduces the hardness of the short steel penetrator and reduces penetration performance in the NATO steel plate targets, especially at lower temperatures.

Technical Challenge 3 of Projectiles (Fragmentation)

Another well-known disadvantage with conventional ball ammunition is its tendency to fragment into many pieces upon impact with a ballistic gelatin target. Ballistic gelatin is a material commonly used as a simulation for human tissue to establish terminal ballistic performance. The requirement for a non-fragmenting projectile stems from the Hague Convention IV of 1907, which forbade projectiles or materials calculated to cause unnecessary suffering to the opposing soldiers on the battlefield. An example of a prohibited projectile is the now infamous Dum-Dum projectile which was judged to cause excessive suffering.

Projectile fragmentation in the human tissue is the result of overly rapid transfer of kinetic energy from the projectile to the target and the resulting excessive bending moment acting on the already stressed projectile. As the projectile leaves the air and enters a much higher density medium, such as human tissue, its stability is immediately compromised and it begins to tumble rapidly. This is a good means of transferring kinetic energy to the target, but is considered as causing excessive injury to the opponent if the tumbling projectile does not remain intact, as is often the case with the conventional three-piece projectile (ball) ammunition.

Since the interior of the conventional ball projectile comprises one steel and one lead component, the projectile normally bends at this steel/lead interface and shears the copper alloy jacket there. This interface acts as a hinge that bends until it breaks and then allows the lead to disperse in human tissue as tiny fragments that are very difficult to remove from the soldier after the battle. Some countries are in the process of considering restricting or eliminating the use of such fragmenting projectiles by their infantry soldiers, but to date no reliable solution has been identified.

Solution to Technical Challenges 1 & 2 of Projectiles with a Jacketed, All-Steel Core Annealing is not required with the one-piece, all-steel core projectile, so penetration in hard targets is improved, even at lower temperatures. Stripping is no longer a concern for the one-piece, all-steel core projectile since there is no longer an internal interface between forward and rearward parts of the core to worry about, but it does generate other problems, since the hard steel core does not readily deform and causes greatly increased friction as the projectile travels down the bore which in turn creates increased heating of the gun barrel.

Solution to Technical Challenge 3 of Projectiles with a One-Piece, Jacketed All-Steel Core A jacketed, one-piece steel core projectile is not sensitive to high bending moments, since there is no "hinge" upon which the bending moment may act. As a one-piece steel core projectile tumbles in tissue, it remains intact and thus does not violate the Geneva or Hague conventions since it is relatively easy to locate and remove after the battle. It also does a very good job of transferring energy quickly and incapacitating the opponent in a more humane manner since the one-piece, longer projectile will tumble more rapidly without breaking into numerous small fragments.

Technical Challenge 1 of a Jacketed All-Steel Core Projectile (Increased Stress)

The main drawback with a hard, one-piece steel core projectile interior is that suddenly the projectile engraving forces are dramatically increased and the mechanical stresses generated will induce premature gun barrel wear through the enormous friction forces generated.

The exterior contact surface of the projectile may be called the "driving band". This is the area of the projectile that is in direct contact with the rifling of the weapon and undergoes plastic deformation when fired through a gun barrel. In conventional ball projectiles, the lead core under the copper jacket is directly beneath the driving band. The soft copper jacket and malleable lead core are ideal materials for a driving band since they are readily plastically deformed and slightly lengthen longitudinally under axial compression in accordance with Poisson's ratio for these metals.

It must be recalled that the process of firing a conventional spin stabilized projectile down a gun barrel requires extruding an oversized cylinder down an undersized tube. The tube has grooves and lands with a helical twist and causes the cylinder to rotate inside the barrel, thus ensuring stability during flight. This is the principle of the spin-stabilized projectile which is sensitive to the length to diameter ratio of the projectile.

The stresses on today's modern infantry small calibre projectiles are enormous due to the very high muzzle velocities and very fast spin rates that are involved. The current projectiles are at the limits of what is possible in mechanical design and production must be continuously monitored to ensure quality and performance. In some cases, the metal forming processes involved in manufacturing the copper projectile jacket induce residual stresses that may slightly diminish projectile integrity. This is usually a manageable issue with lead-containing projectiles since the lead is so soft it deforms quite readily and friction forces are normally manageable. Introducing a one-piece hard steel core may strengthen the projectile design, but causes other problems.

Technical Challenge 2 of Jacketed All-Steel Core Projectile (Coppering)

Excessive friction heating due to the one-piece, all-steel core projectile may lead to accelerated mechanical wear of the interior surface of the gun barrel (and gun barrel lining if one is present) that unacceptably shortens the service life of the weapon. The cause is localized surface melting of the copper projectile jacket inside the gun barrel which causes a build-up of jacket material where barrel heating is highest. This phenomenon is known as "coppering" and must be resolved by reducing friction forces within the barrel.

Many modern infantry assault weapons have a metallic lining inside the gun barrel to extend barrel life. Typically chromium is chosen for its excellent hardness and resistance to mechanical wear. Chromium has the additional advantage of providing a smooth surface for the travel of copper-jacketed projectiles since copper is not soluble in chromium. Chromium is soluble in steel however, due to the atomic affinity of copper and iron, so if mechanical friction increases to such a level that the chromium gun barrel coating is compromised, coppering will begin to occur rapidly on the exposed steel surface.

Technical Challenge 3 of a Jacketed All-Steel Core Projectile: (Increased Dispersion)

Once coppering starts to occur, the resulting build-up causes the interior diameters of the rifle lands and grooves to decrease at the exposed surfaces and now the projectile has to pass through restricted zones that induce even more localized stress. This problem will continue to worsen as more projectiles are fired through the gun barrel unless the barrel is thoroughly cleaned with a "de-coppering" agent. Coppering often results in a disruption of proper projectile spin or even complete loss of projectile integrity, either inside the barrel or upon exiting the muzzle of the weapon. This additional instability or "projectile yaw" in flight due to barrel coppering also leads to greatly increased impact dispersion on the target with a reduction of accuracy and reduced probability of hitting the target that is unacceptable to the shooter.

An obvious means of reducing friction forces in an all-steel core projectile and thereby reducing coppering and stripping is by simply reducing the projectile diameter. However, other potential problems may be encountered with the performance of spin-stabilized small calibre projectiles related to a decreased projectile diameter.

Technical Challenge 4 of Poorly Spun, Jacketed, All-Steel Core Projectile (Key-Holing)

If proper projectile spin transfer from the rifling is disrupted, it is evidenced by projectile impacts on the paper target that exhibit evidence of "keyholing" or impact at a noticeable angle of yaw. This is highly undesirable behaviour for small arms ammunition since in reality, penetration of hard targets is thus reduced because the projectile is no longer traveling in a straight line when striking the target material Technical Challenge 5 of Poorly Spun, Jacketed, All-Steel Core Projectile: (Balloting)

If the projectile fails to spin properly inside the rifling of the gun barrel, it may exhibit balloting (uncontrolled yawing motion inside the barrel) and damage the barrel lands and grooves. Once this happens, the gun barrel is no longer serviceable and must be replaced since accuracy is degraded and jacket stripping may occur.

Many of these above-mentioned problems can arise from the choice of steel or any other hard material as a one-piece replacement for the existing conventional ball core components.

Technical Challenge 6 of a Jacketed, All-Steel Core Projectile (Aft End Closure)

Properly closing the base of a conventional lead core ball projectile is not a complex affair, since the lead is easily formed and readily adheres to the final form imparted onto it by the copper jacket during the projectile closing operation. This is much more difficult with an all-steel core, since it cannot be deformed during the closing operation.

Technical Challenge 7 of a Jacketed, All-Steel Core Projectile (Increased Chamber Pressure)

Another design challenge due to the choice of an all-steel core component is the increased weapon chamber pressure generated during firing of the cartridge. Maximum chamber pressure values are strictly regulated in commercial and military ammunition for obvious safety reasons. If ammunition chamber pressures generated exceed prescribed limits during firing, catastrophic barrel failure may result as a worst case, or at best, the repeated high pressure cycles will contribute to accelerated fatigue of the metal parts and premature wear of the weapon The challenges of achieving maximum muzzle velocity while maintaining acceptable chamber pressures are well understood in conventional ball ammunition. The increased pressure experienced with all-steel core projectiles is directly related to the increased rifling engraving stresses described above.

Again, the obvious means of reducing weapon chamber pressure and projectile engraving stresses is by simply reducing the exterior diameter of the projectile. This is true of conventional as well as all-steel core projectiles, but diameter reduction does generate a proportional reduction in accuracy on target, since projectile engraving and thus uniformity of projectile spin is reduced. If the projectile diameter is reduced beyond a given limit, projectile balloting may occur. Clearly, simple projectile diameter reduction is not an acceptable solution to eliminate high chamber pressure, excessive projectile stress or barrel wear.

It would therefore be desirable to provide a jacketed, non-toxic projectile which:

1. contains no lead;
2. has a one-piece core preferably of steel;
3. has a core suited for improved penetration performance in hard targets;
4. meets industrial and military specification requirements for gun barrel wear;
5. provides controlled chamber pressure;
6. provides required accuracy;
7. maintains projectile integrity;
8. maintains stability in flight; and
9. will not fragment upon impact in ballistic gelatin, even at very short ranges. The present invention endeavours to address such objects.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

This invention relates to non-toxic, improved performance, small calibre, jacketed projectiles in general, particularly those up to 12.7 mm calibre. More particularly, it relates to a jacketed projectile comprising a solid central core with a midsection or central portion which is not in continuous circumferentially contact with the jacket for at least a portion of its length. The jacket in this region is "unsupported" by the core in the sense that little resistance to engraving forces applied to the jacket in this region is provided by material underlying the jacket. This absence of support arises within a portion of the midsection of the core. As engraving develops along the jacket of the projectile during firing support for the jacket overlying the midsection can progressively build-up. In this manner, the discontinuous development of stresses minimized.

According to a preferred variant of the invention this midsection is tapered or generally frusto-conical in shape. Further, in a preferred embodiment, a separation or gap is provided between the jacket and the core along the surface of the midsection or fustro-conical portion of the core. This gap encircles the frusto-conical central portion and is itself tapered. The frusto-conical portion of the projectile core preferably has a half-conical angle, referring to the included angle of the cone as the conical angle, of between 0.7° and 1.3°, more preferably between 0.07° and 1.0° and even more preferably about 0.85° to 0.95° for a 5.56 mm round, ideally 0.85°.

According to the most preferred embodiment of the invention, the tapered encircling gap is air-filled. However, such gap may be filled with any compressible substance which is compatible with incorporation into a small arms projectile and which contributes little support to the jacket during the engraving of the jacket by rifling in a barrel, e.g., it provides only a small portion of resistance to engraving forces over at least a portion of the midsection of the projectile.

Although not essential, a projectile according to the invention preferably has a steel core, which comprises carbon steel. This steel core material may have a hardness of at least 45 on the Rockwell C hardness scale. An alternate example of the core material could be tungsten or any tungsten alloy. The jacket material preferably comprises gilding metal which is suited to be engraved upon firing through a rifled barrel. The gilding metal jacket may comprise, for example, approximately 90% copper and 10% zinc.

The core of the projectile is preferably of one-piece with a forward portion having an ogival front end, optionally truncated at its forward tip, followed by the tapered or frusto-conical portion, tapering towards its projected apex in the forward direction. The junction between the rear of the ogival front end portion and the front end of the midsection/frusto-conical portion preferably provides a relatively smooth transition zone between the two sections, e.g. without a ridge or ledge.

Rearwardly of the midsection portion, the projectile core is provided with a shorter cylindrical portion preferably with a constant circular diameter in this region, the jacket is in substantial contact with the core. This contact need not be absolutely complete. For example, the cylindrical surface of the core may be fluted or otherwise shaped to provide small gaps, so long as the driving band function is not impaired. This cylindrical region extends rearwardly towards a final, rearward, inwardly tapering, end portion of the core—a "boat-tail". Preferably, the cylindrical portion of the core is less than one third, more preferably less than 30% of the length of the midsection portion. Preferably the rearward inwardly tapering, conical, boat-tail end portion of the core has an half-conical angle of about 83°. The projectile jacket overlies such inwardly tapering end portion and preferably extends over onto the final end-surface of the core to ensure effective attachment of the jacket to the core.

In order to achieve the same projectile mass (to retain the required level of muzzle kinetic energy for equivalent terminal ballistic performance on the target), a one-piece all-steel core made in accordance with the preferred embodiment of invention is longer than the corresponding ball round with a conventional steel penetrator and lead core. The length of the projectile of the invention is preferably approximately the same length as that of a conventional tracer round, cf FIG. 3, of corresponding calibre. Further, the projectile of the invention is fitted into a cartridge casing so as to provide a cartridge having the same overall length as a corresponding standard round, enabling the projectile of the invention to function in unmodified existing weapons.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 4:
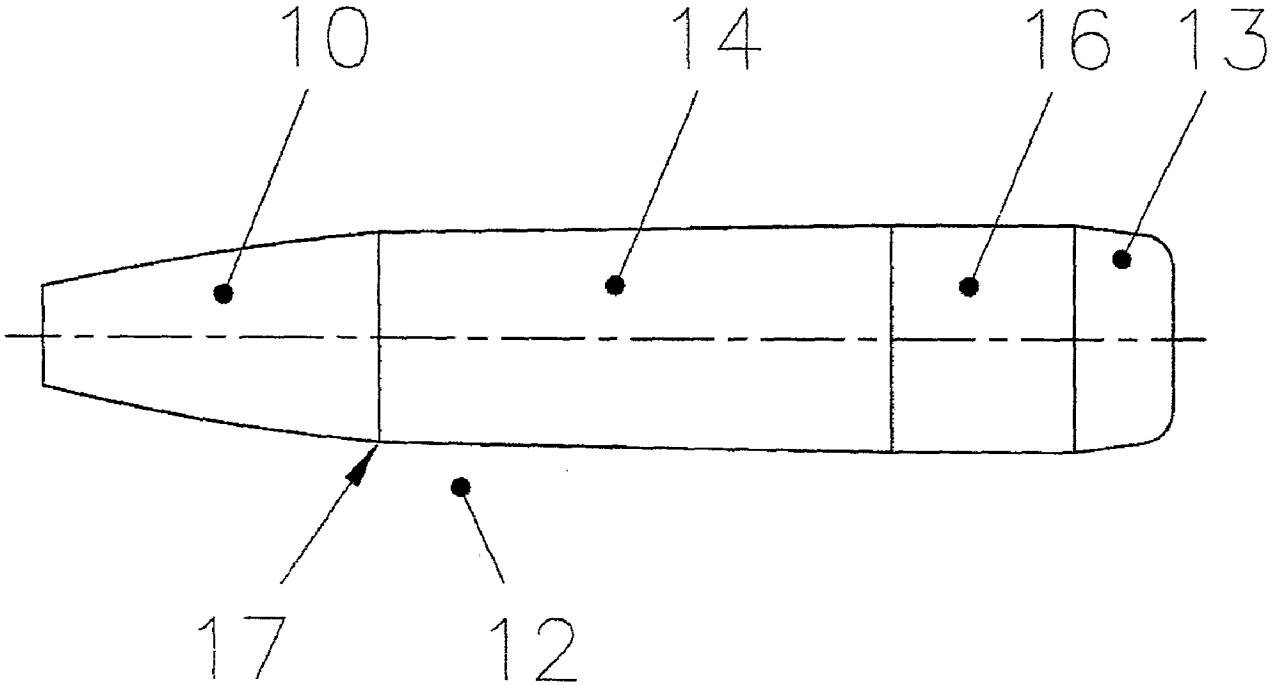
FIG. 4 shows a side view of the core for a projectile according to the invention.
Figure 5:
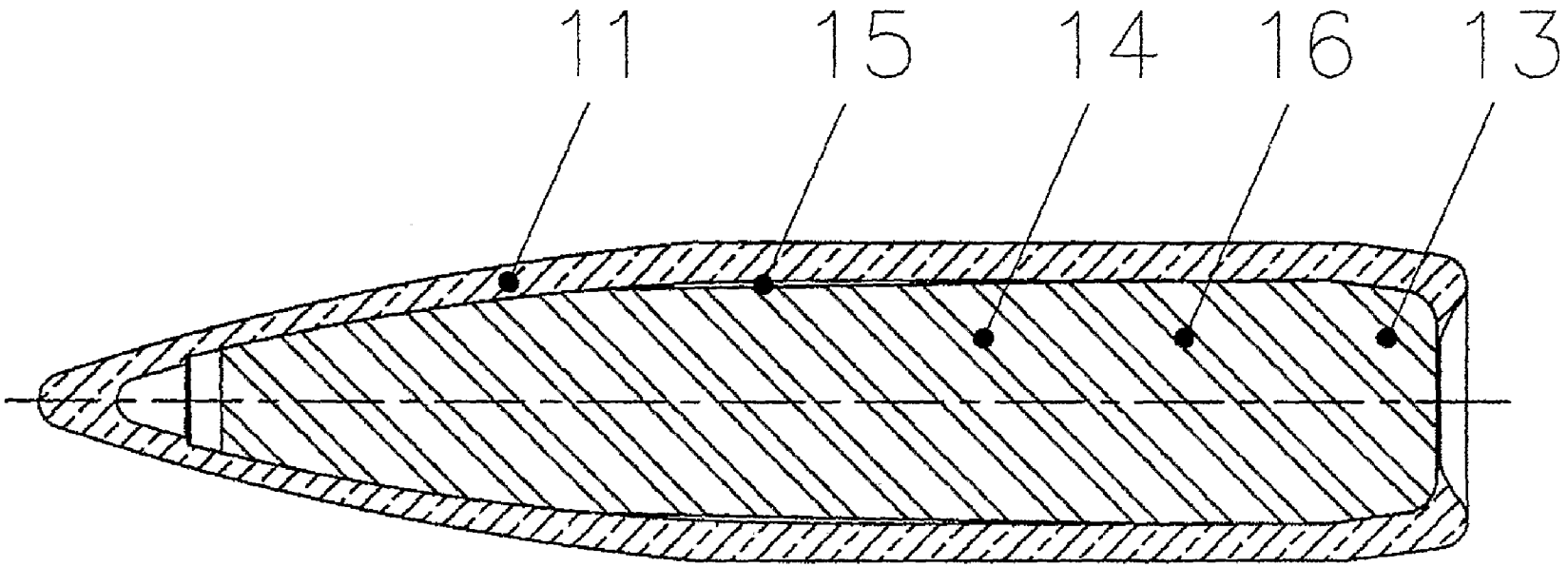
FIG. 5 shows a cross-sectional side view of a complete projectile according to the invention.
Figure 6:
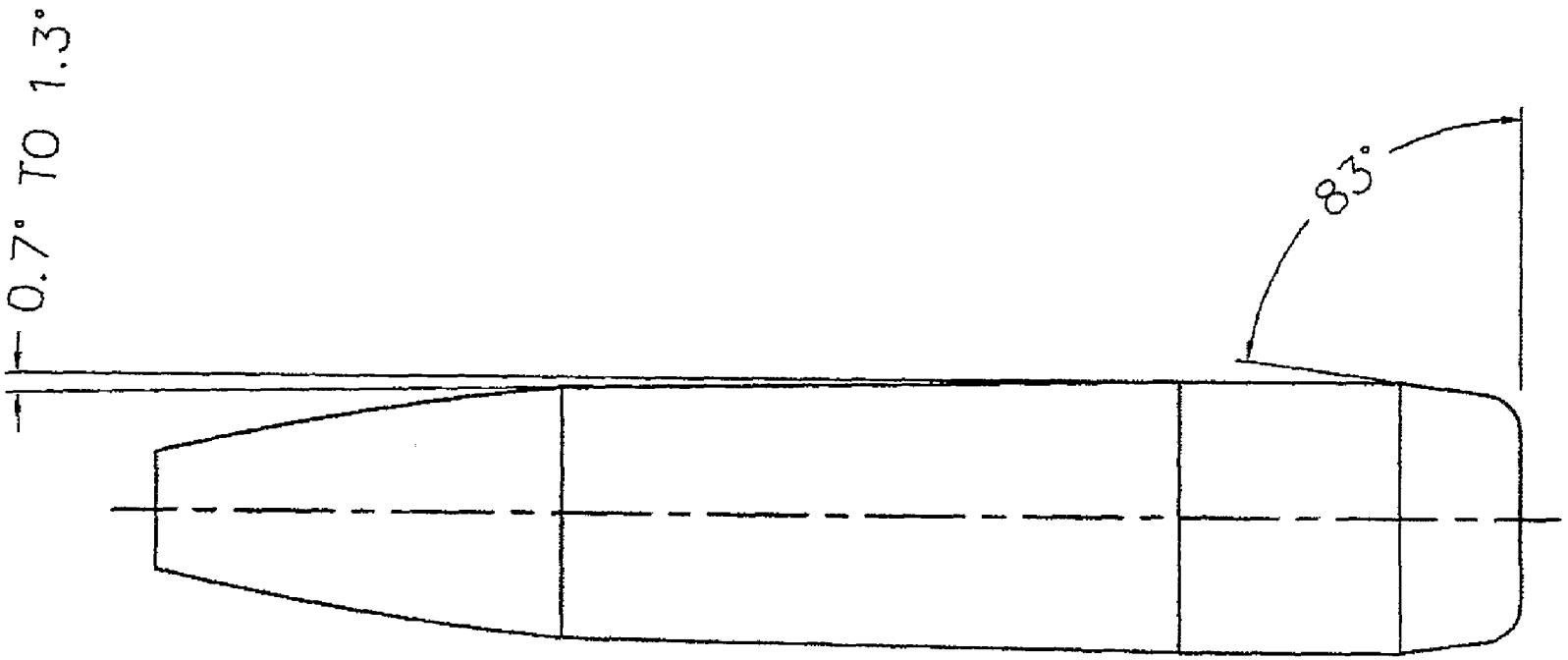
FIG. 6 is a side view as in FIG. 4 indicating preferred angular dimensions for the central core portion and rearward end portions of the projectile, according to the invention.

According to a preferred embodiment of the invention as shown in FIGS. 4, 5 and 6, a projectile is provided with an all-steel core 12 that is contained within a jacket 11 of copper alloy or gilding metal. An ogival front-end section 10 of the projectile facilitates projectile feeding from weapon magazines and/or belts by presenting a smooth surface with no angles to get caught on weapon components during feeding to the chamber. The core 12 has a corresponding ogival shape, however the core may be truncated at its forward leaving an optional, small, air gap at the forward tip of the projectile as an artifact of manufacture.

Extending rearwardly from the ogival front end 10 is a midsection that incorporates a frusto-conical portion 14 of the all-steel core 12, the frusto-conical portion 14 having a small half-conical angle, e.g. an angle of approximately 0.85°. This small angle of taper facilitates ensuring that the junction 17 of the ogival front end and the frusto-conical portion 14 is a relatively smooth, blended, junction 17, although the surfaces need not be perfectly co-aligned at their juncture.

The presence of the small conical taper in the frusto-conical portion 14 enables the partially cylindrical jacket 12 to be formed so that the exterior surface of the frusto-conical portion 14 is not in continuous contact with the interior surface of the projectile jacket 11, removing the support that would otherwise be provided to the jacket 11 if it were directly adjacent to the core. Thus in the depicted preferred embodiment there is a gap 15 separating the projectile jacket 11 and the frusto-conical portion 14 so that the two are not in continuous contact over the midsection portion of the projectile. In the preferred embodiment the gap 15 between the jacket 11 and the core 12 is filled with air.

The point of commencement of the separation is shown in FIG. 5 as coinciding with the juncture between the ogival front portion 10 and midsection of the core 12. This is slightly forward of the juncture between the ogival front portion of the jacket 11 and the commencement of the cylindrical portion of the jacket 11 whereby the gap 15 is formed.

A short cylindrical section 16 of the core 12 extends rearwardly from the frusto-conical portion 14. The jacket 11 is in contact with the core 12 in this region so that this section serves as the principle driving band area. Over the cylindrical section 16, the jacket 11 will become fully engraved on firing. Rearwardly of the short cylindrical section 16 is a shorter rearwardly-tapering end section 13 with an exterior complimentary conical angle of approximately 83° or a 7° half-conical angle.

The projectile is assembled with the jacket 11 in direct contact with the one-piece core 12 along the ogival front end 10, the short cylindrical section 16 and the rearwardly tapering end portion 13. However, by reason of the frusto-conical shape of the intervening middle portion 14 and the fact that the jacket 11 is generally cylindrical in shape, particularly on its inside surface, there is a small separation or gap 15 between the projectile jacket 11 and the frusto- conical portion 14 of the core 12. The half-conical angle of the frusto-conical portion 14 is, for a 5.56 mm round, preferably 0.85° to 0.95°, but may preferably range between 0.7° and 1.0°. This gap 15 allows the copper jacket material to flow plastically during engraving and without rupturing from no significant interference from the unyielding hard, steel core underneath, at least in the forward portion of the midsection. The deformation of the jacket 11 must be sufficient to maintain acceptable chamber pressure values, but not so great as to hinder the transfer of spin to the projectile required for stability. The range of permitted angles for the tapered portion 14 of the core 12 is also important for ensuring the accuracy of the projectile in flight, but this is not the only factor involved.

The value of the angle of the frusto-conical portion is additionally important since too large an angle could result in an unsupported ogival front end portion 10 whereby the projectile may not properly seat in the barrel. This can lead to an increase in projectile yaw in flight and reduced accuracy on the target. If the angle of the frusto-conical portion 14 is too small, the gap 15 will be too small and increase projectile engraving forces will arise.

Further, it is highly preferable that the length of the cylindrical parallel portion 16 be less than the length of the frusto-conical portion 14, preferably substantially less. The reason for this is as follows.

The ratio of the length of the short cylindrical section 16 of the core 12 to the longer frusto-conical section 14 is important for maintaining stability of the projectile in flight. This ratio should be preferably less than one third, more preferably less than 0.3, ranging between 0.3 and 0.1, with best results obtained at a ratio of about 0.2 in 5.56 mm projectiles. If the cylindrical parallel portion 16 is too long, excessive chamber pressure and barrel wear will result. If this portion 16 is too short, the projectile will slip in the gun barrel rifling and diminish in stability in flight, thus affecting accuracy.

The section of jacketed projectile that acts as the main driving band area (over the cylindrical portion 16 of the core) is in continuous contact with the rifling, while the frusto-conical section 14 of the core 12 is only partially and progressively supplying support to the jacket 11 while it is in contact with the rifling. Engraving forces are highest over the cylindrical portion 16.

The tapered gap 15 between the jacket 11 and the frusto-conical portion 14 is an important aspect of the invention since it allows the projectile to have acceptable internal and external ballistic performance characteristics, with greatly enhanced terminal ballistic properties due to the hard steel core. The taper allows for the gradual build-up of engraving stresses to ensure only acceptable stresses arise while maintaining good precision on the target.

Other designs were tried wherein the gap 15 was cylindrical or of other non-conical shapes with the result that less a satisfactory, though functional, target accuracy was achieved. The preferred use of a tapered or conical midsection does not exclude other shapes from the scope of the invention, so long as adequate performance is provided, but the preferred embodiment incorporates a frusto-conical shape.

As the jacketed projectile starts advancing down the barrel rifling from its starting position in the forcing cone of the rifling, it gradually and progressively engraves in the lands and grooves of the rifling. The exact initiation point of engraving occurs somewhere along the length of the frusto-conical section 14 and engraving is fully complete when it is in full contact with the short cylindrical section 16. This feature is important since the various small calibre weapon platforms have different land and groove diameters, and can be found in various states of wear. Using the projectile of the invention, these differences can be accommodated.

The gap 15 may be empty or occupied by a substance or material. The material chosen to occupy the gap 15 is preferably inexpensive, easy to manufacture, easily compressible and therefore free of any tendency to provide a deleterious effect on the projectile jacket 11 during the compressive action of engraving. Otherwise such material could potentially cause the jacket 11 to rupture when it is being deformed through engraving. Air has been found to be the most satisfactory substance. Other gases may be employed or a compressible or engraveable solid could also be employed.

Accordingly, when reference is made herein to an "air gap" or "gap", this is intended to refer to the region between the core 12 and the jacket 11 in the most general sense. Whatever material occupies the space, it is acceptable so long as it provides initially little or no support to the jacket and allows the projectile to respond appropriately when the projectile is engaged with rifling during firing.

Figure 1:
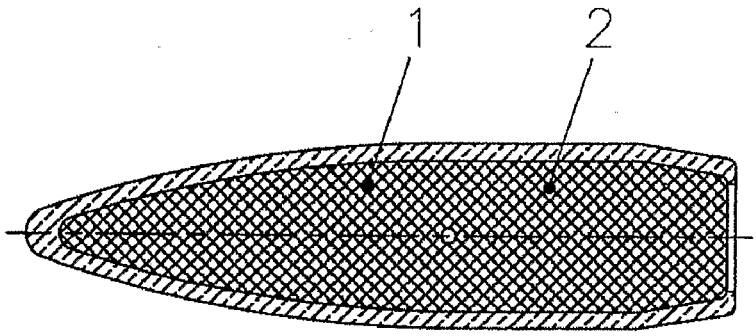
FIG. 1 PRIOR ART
FIG. 1 shows cross-sectional view of a prior art M193 type projectile with a one-piece jacketed lead core.
Figure 2:
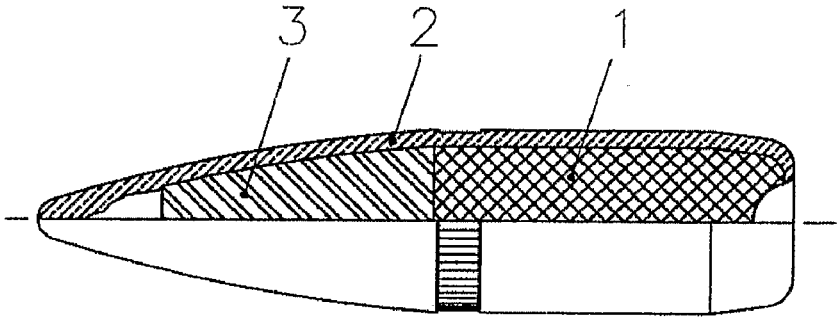
FIG. 2 PRIOR ART
FIG. 2 shows a cross-sectional view of a prior art SS109 or C77 type projectile incorporating a front steel penetrator portion.
Figure 3:
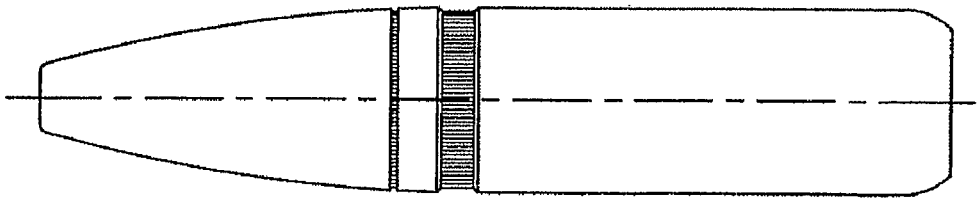
FIG. 3 PRIOR ART
FIG. 3 shows a side view of a longer prior art, C78, tracer projectile.

The length of the projectile of the invention is preferably approximately the same length as that of a conventional tracer round, cf FIG. 3, of corresponding calibre. Further, the projectile of the invention is preferably fitted into a cartridge casing so as to provide a cartridge having the same overall length as a corresponding standard round. This enables the projectile of the invention to function in unmodified existing weapons. While the lengthened projectile encroaches on the seating depth of the projectile into the cartridge case, nevertheless, as with tracer rounds, sufficient space remains to provide a full propellant charge effective to achieve desired performance. Care must be taken, however, when selecting an appropriate propellant to avoid excessive compression of the propellant inside the cartridge case.

The radius at the junction of the rear face of the rearwardly tapering section 13 (the boat tail section) must be sufficiently large to allow adequate mating of the copper alloy jacket 11 over the base of the core 12. If the radius is too small, the jacket material does not adhere, or close properly. This may result in high pressure propellant gasses infiltrating between the two components (core 12 and jacket 11) and cause projectile stripping the moment the projectile leaves the barrel and is no longer supported by the rifling of the gun barrel.

Several tests were made during the development of this new projectile; involving various combinations of angles and lengths of the two main core portions 14, 16. High chamber pressures (380 Mpa) were measured when the length of the cylindrical section 16 was too long. This is over NATO specification limits and potentially dangerous. The final configuration resulted in pressures around 330 Mpa.

Several tests were also made to establish the optimal angle of the frusto-conical section 14. The first test resulted in a barrel that was worn beyond acceptable limits after only 2,000 rounds fired in approximately 90 minutes, as per NATO test specifications. On the second try, after several months of design effort the angle was slightly increased and the length of the cylindrical section 16 was reduced. This time the barrel only became excessively worn after 4,000 rounds fired.

On the third and successful attempt, the diameter of the steel core 12 in the driving band region, and the length of the cylindrical section 16 were slightly reduced. With this change the projectile passed the NATO barrel wear performance requirements, even after 5,000 rounds were fired. When the diameter of the driving band portion 16 of the steel core 12 was further reduced, accuracy on target was substantially diminished.

These tests are in respect of meeting NATO standards. They do not represent minimum functionality, which may be well below such standards for other military or commercial applications.

CONCLUSION

The foregoing has constituted a description of specific embodiments showing how the invention may be applied and put into use. These embodiments are only exemplary. The invention in its broadest, and more specific aspects, is further described and defined in the claims which now follow.

The invention claimed is:

1. A jacketed projectile having front and rear ends separated by the length of the projectile and comprising:

a) an engravable jacket, and b) a central core, the central core having a midsection portion which is not in continuous contact with the jacket over at least a portion of the midsection portion to allow engraving to occur on the jacket without full support from the core, wherein the midsection portion is frusto-conical in shape and tapered, tapering towards only the front end of the projectile to provide a tapered separation between the jacket and the core along at least a portion of the length of the midsection portion to allow for progressive engraving of the jacket when the projectile is fired through a rifled barrel.

2. A jacketed projectile as in claim 1 comprising wherein the tapered separation provides a fully encircling gap between the jacket and the core along at least a portion of the length of the midsection portion of the core.

3. A projectile as in claim 2 wherein the encircling gap is in the form of a tapered gap present between the jacket is unsupported in the midsection portion along at least a portion of the length of the midsection portion, over the length of the separation.

4. A projectile as in claim 2 wherein the encircling gap is in the form of a fully encircling tapered gap present between the jacket and the full length of the midsection portion.

5. A projectile as in claim 2 wherein the gap is occupied by a compressible medium.

6. A projectile as in claim 5 wherein the compressible medium is air.

7. A projectile according to claim 1 wherein the half-conical angle of the frusto-conical portion of the core is between 0.7° and 1.0°.

8. A projectile according to claim 1 wherein the half-conical angle of the frustro-conical portion of the core is between 0.85° and 0.95°.

9. A projectile according to claim 1 comprising a short cylindrical portion of the core having an outer surface, the cylindrical portion extending rearwardly from the midsection of the core, wherein the jacket and outer surface of the cylindrical portion are in generally continuous contact with each other for the length of the cylindrical portion.

10. A projectile according to claim 9 wherein the cylindrical portion of the core is less than 30% of the length of the midsection portion.

11. A projectile as in claim 1 wherein the central core is principally composed of a material selected from the group consisting of carbon steel, tungsten, tungsten carbide, tungsten alloys, tungsten-nylon compounds, tungsten-tin compounds and mixtures thereof.

12. A projectile as in claim 11 wherein the central core has a hardness and the hardness of the central core is at least 45 on the Rockwell C hardness scale.

13. A projectile as in claim 1 wherein the core comprises a forward portion mounted ahead of the midsection, said forward portion having an ogival shape over at least a portion of its surface and wherein the junction between the forward and the midsection portions provides a relatively smooth transition zone.

14. A projectile as in claim 13 comprising an inwardly tapering end portion of the core positioned rearwardly of the cylindrical portion.

15. A projectile as in claim 14 wherein the rearwardly tapering end portion of the core has a half-conical angle of about 7 degrees.

16. A projectile as in claim 1 wherein the jacket material comprises gilding metal.

17. A projectile in accordance with claim 16 wherein the gilding metal jacket comprises approximately 90% copper and 10% zinc.

18. A projectile according to claim 17 wherein the gilding metal jacket has a thickness greater than a corresponding thickness of a jacket used on conventional ball projectiles of similar caliber.

19. A projectile according to claim 18 wherein the gilded metal jacket has a minimum thickness of 0.635 mm for a 5.56 mm ball round.

* * * * *